US006348748B1

(12) United States Patent
Yamamoto

(10) Patent No.: US 6,348,748 B1
(45) Date of Patent: Feb. 19, 2002

(54) FAN MOTOR

(75) Inventor: Katsuhiko Yamamoto, Kamo (JP)

(73) Assignee: Toshiba Home Technology Corporation (JP)

( * ) Notice: Subject to any disclaimer, the term of this patent is extended or adjusted under 35 U.S.C. 154(b) by 0 days.

(21) Appl. No.: 09/481,898

(22) Filed: Jan. 12, 2000

(30) Foreign Application Priority Data

Mar. 31, 1999 (JP) ..... 11-092819

(51) Int. Cl.[7] ..... H02K 9/00; H02K 9/06

(52) U.S. Cl. ..... 310/62; 310/67 R; 361/697; 415/178

(58) Field of Search ..... 310/62, 63, 67 R; 165/80.3, 120, 121, 122; 361/694, 695, 696, 697; 415/177, 178; 454/184

(56) References Cited

U.S. PATENT DOCUMENTS 3,730,642 A * 5/1973 Barnstead et al. ..... 310/62
5,484,262 A * 1/1996 Thomas et al. ..... 415/178
5,689,404 A * 11/1997 Katsui ..... 361/697
5,701,045 A * 12/1997 Yokozawa et al. ..... 310/62
5,727,624 A * 3/1998 Ko et al. ..... 165/121
5,810,554 A * 9/1998 Yokozawa et al. ..... 415/176
5,893,705 A * 4/1999 Khan et al. ..... 417/354
5,896,917 A * 4/1999 Lemont et al. ..... 165/80.3

FOREIGN PATENT DOCUMENTS

JP 7-54876 6/1995

* cited by examiner

*Primary Examiner*—Karl Tamai
(74) *Attorney, Agent, or Firm*—Akerman Senterfitt

(57) ABSTRACT

A fan motor with an improved inhaling structure so as to enhance ventilation efficiency and performance, as well as cooling performance. An outer housing member 7 has a respective face opposite to a drive unit 11. An intake hole 13 of an arbitrary diameter is provided in a first face of the outer housing member 7, while another intake hole 15 of an arbitrary diameter is provided in a second face thereof. Thus, a substantial amount of air is taken in from the two faces of the outer housing member 7, thereby drastically improving the ventilation efficiency. Even though an inhaling passage is not ensured substantially on a top face of the outer housing member 7, the air is able to be inhaled even through a slight clearance due to the other intake hole 15, thus improving the cooling performance. The air taken in from the intake holes 13 and 15 of the outer housing member 7 is smoothly discharged toward the exhaust direction of a fan 5, without striking on walls of a casing 1 and a cover 12.

5 Claims, 5 Drawing Sheets

FAN MOTOR

BACKGROUND OF INVENTION

1. Filed of the Invention

The present invention relates to a fan motor, particularly to a flat type fan motor with an improved ventilation structure.

2. Prior Art

Conventional micro processor units (hereinafter called MPU), which are mounted inside the casing of a thin electronic appliance such as a notebook type personal computer, have caused too much heat generation due to their large power consumption, and thus it has been imperative to provide MPU with a fan motor for cooling the same. For example, in Japanese Patent Examined Publication No.7-54876 is disclosed a heat sink device which comprises a plurality of fins vertically provided on a base of the heat sink, said fins being arranged along a periphery of a fan motor so that at least an amount of air flow directed to one direction may differ from that directed to other directions, thereby allowing the air flow from the fan to strike effectively and directly on the fins so as to enhance the efficiency of radiation from the fins.

However, there have been various problems associated with such axial-flow fan motor for a thin electronic appliance, as disclosed in the prior art, due to the characteristic specifically required for the product, i.e., a limited height or thickness therefor.

Specifically, a less ventilation space between a casing of a thin electronic appliance and another casing which makes up an outer shape of a fan motor, has led to extremely inferior ventilation efficiency, because a substantial amount of air cannot be introduced into the inside of the casing. Further, due to an intake face being at right angles or orthogonal to an exhaust face so that air taken in the casing strikes a wall thereof, and thus the noise performance is inferior due to a ventilation passage being far from an ideal one. Furthermore, as an intake passage is inevitably determined by a fan motor when mounting the same to a thin electronic appliance, the cooling performance inside the whole appliance has become worse.

SUMMARY OF THE INVENTION

To eliminate the above-mentioned problems, it is, therefore, a primary object of the present invention to provide a fan motor with an improved inhaling structure.

It is another object of the present invention to provide a fan motor with improved ventilation efficiency and performance, improved cooling performance, as well as superior heat conductance.

To attain the above objects, there is proposed, from a first aspect of the invention, a fan motor which comprises a fan for taking in and exhausting air, a drive unit for driving said fan and a housing member for accommodating said fan and drive unit, said housing member having faces which are opposite to said drive unit, each face being provided with an intake hole of an arbitrary diameter.

According to a first aspect of the invention, as the intake hole of an arbitrary diameter is provided not only on a first side face of the housing member but also on a second side face thereof, a substantial amount of air can be taken in from both side faces of the housing member, thereby drastically improving ventilation efficiency, as compared to conventional ones. Further, by providing a second side face of the housing member with a second intake hole, the inhalation of air becomes possible even through a slightest clearance, even in the event that a substantial intake passage is not ensured at the first side face of the housing member when mounting a fan motor to the inside of the casing of an electronic appliance, whereby the cooling performance is improved. Furthermore, even though the inhaling direction of the fan is orthogonal to the exhaust direction thereof inside the outer housing member, the air taken in from one intake hole thereof will not strike on the wall thereof, but will be smoothly discharged toward the exhaust direction of the fan, together with air taken in from the other intake hole thereof. Accordingly, unlike conventional fan motors, the air taken in from the intake hole will not strike and damage the wall, whereby the inferior noise performance can be improved.

From a second aspect of the invention, there is proposed a fan motor having the elements of said first aspect, which further comprises a radiator provided in the exhaust direction of the fan. With the structure, if heat from a certain heat source such as MPU reaches the radiator thermally conductibly connected with the heat source, air that has been efficiently taken in from both faces of the housing member will deprive the radiator of the heat thereof in the exhaust direction of the fan so speedily that the temperature rise of the heat source can be suppressed effectively. By providing the radiator in the exhaust direction of the fan in this way, the cooling effect of the heat source thermally conductibly connected with the radiator can be enhanced.

From a third aspect of the invention, there is proposed a fan motor having the elements of said first aspect, wherein the intake hole formed on the first face of said outer housing member is opposed to a face of a thin casing with a first space intervening therebetween, while the other intake hole formed in the second face thereof is opposed to a heat source with a second space intervening therebetween. With the structure, relatively cold air located in the vicinity of the first face of the outer housing member and relatively hot air located in the vicinity of the second face thereof are taken in simultaneously, which are smoothly discharged toward the exhaust direction of the fan while getting mixed.

From a fourth aspect of the invention, there is proposed a fan motor having the elements of any of preceding aspects, wherein said intake holes are formed into different diameters, respectively. With the structure, if there is, for example, a heat generation body in the vicinity of the second face of the outer housing member, the second intake hole in the second side face of the housing member may be larger than the first intake hole in the first side face thereof. Thus, a more amount of air of relatively high temperature located in the vicinity of the second side face of the outer housing member is taken in than the air located in the vicinity of the first side face of the housing member, whereby the cooling effect relative to the heat generation body can be enhanced. Conversely, if the first intake hole in the first side face of the housing member is larger than the second intake hole in the second side face thereof, a more amount of air of relatively low temperature located in the vicinity of the first side face of the outer housing member is taken in, and thus if a radiator is provided in the exhaust direction of the fan, the cooling effect relative to the heat generation body thermally conductibly connected therewith can be enhanced. Accordingly, by varying the respective diameters of the intake holes depending upon the surrounding structure of the fan motor, the cooling effect can be enhanced to the most desirable state.

From a fifth aspect of the invention, there is proposed a fan motor having the elements of any of said preceding aspects, wherein said outer housing member is made up of a material with good heat conductance. With the structure, if a heat source or the like is thermally conductibly connected with the outer housing member, the heat from the heat source is quickly transferred to the outer housing member, thereby effectively dispersing the same by the air taken in from the intake holes.

BRIEF DESCRIPTION OF THE DRAWINGS

Other objects, features and advantages of the invention will be apparent to those skilled in the art from the following description of the preferred embodiments of the invention, wherein reference is made to the accompanying drawings, of which.

DETAILED DESCRIPTION OF THE INVENTION

Hereinafter are explained embodiments of a fan motor of the invention with reference to the attached drawings.

Figure 1:
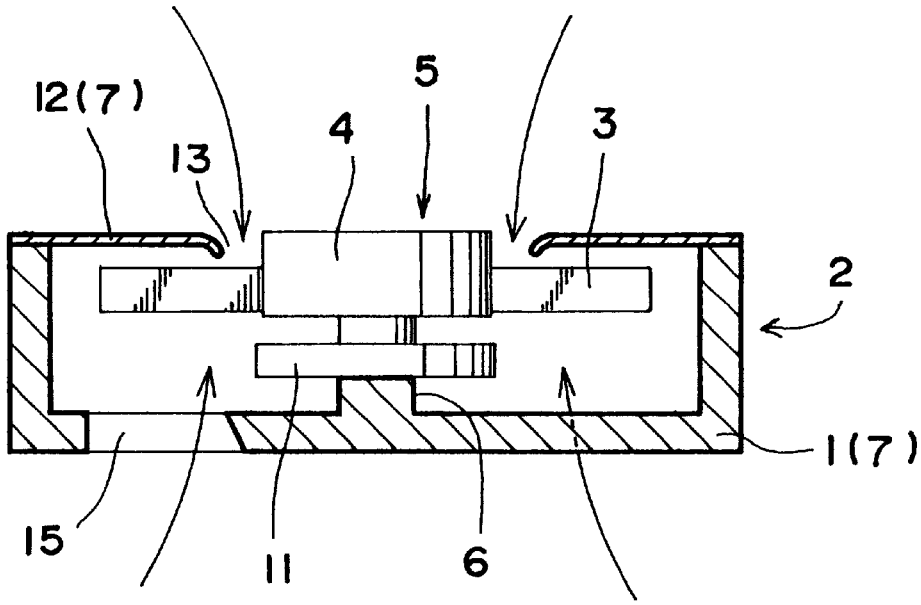
FIG. 1 is a section of the fundamental structure of a fan motor in accordance with a first embodiment of the invention.
Figure 2:
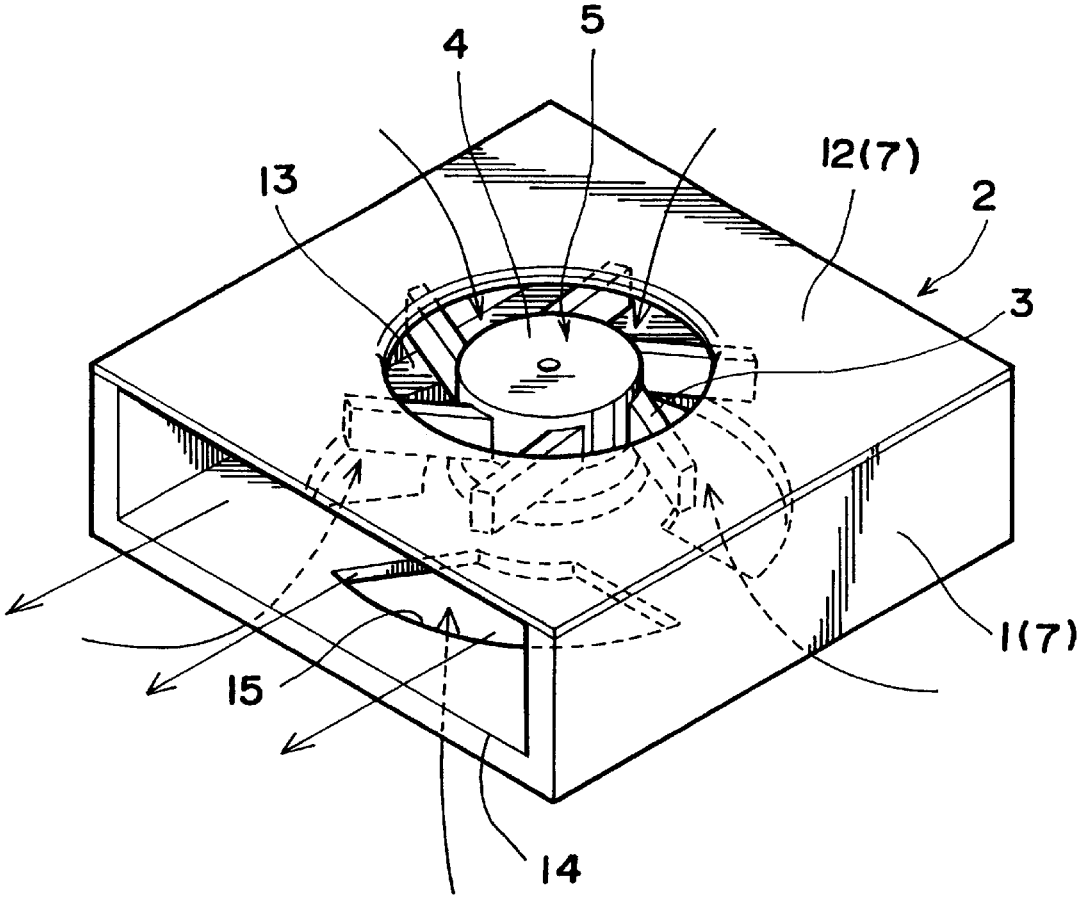
FIG. 2 is a perspective view of the fundamental structure of a fan motor of FIG. 1.
Figure 3:
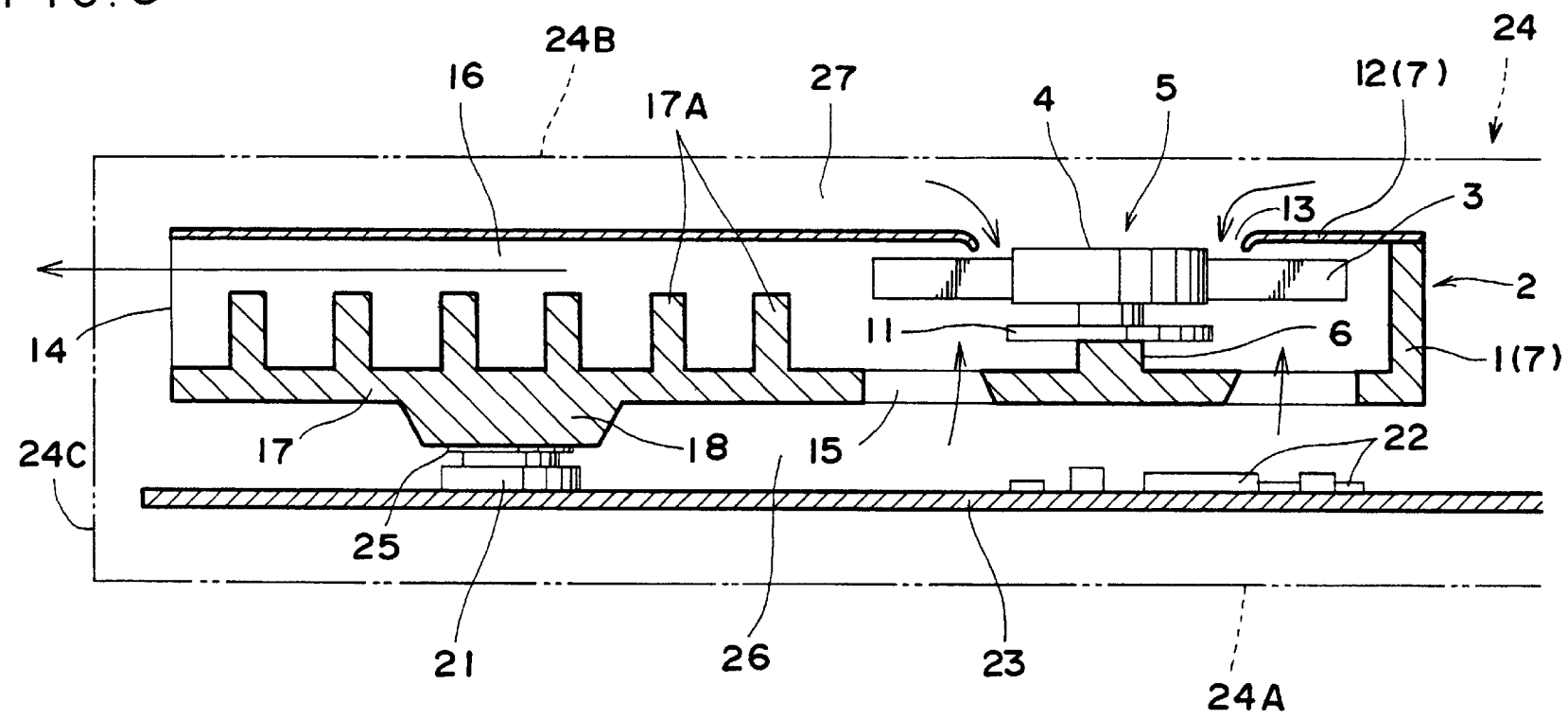
FIG. 3 is a section of a fan motor of FIG. 1, illustrating one practical example of the fan motor of FIG. 1.

In FIGS. 1 through 3 showing a first embodiment of the invention, the fundamental structure of a fan motor of the invention is specifically explained with reference to FIGS. 1 and 2. Reference numeral 1 designates a flatly compressed type casing, which is made of a material indicating good heat conductance, such as aluminum, copper, magnesium or silver. The casing 1 is approximately box-shaped, having an opening extending from a top face to a first side face thereof Inside the casing 1 is provided a fan 5 comprising a cup-shaped rotor 4 and a plurality of blades or impellers 3 integrally formed with the rotor 4 around an outer periphery thereof. The fan 5 is rotatably supported by a bearing tube 6 protruding upwardly from a lower face of the casing 1 through a bearing (not shown). In other words, the bearing tube 6 makes the center of rotation relative to the fan 5. The casing 1, together with a hereinafter-described cover 12, makes up an outer housing member 7 for a fan motor 2.

Reference numeral 11 designates a drive unit securely fixed to the bearing tube 6. The drive unit 11 comprises a stator (not shown), which faces a magnet (not shown) provided along an inner periphery of the rotor 4. The stator is provided with a winding to which is applied a drive current at a preset timing so that attractive and repulsive forces may be developed between the stator and the magnet, thus rotating the fan 5 around the bearing tube 6 inside the casing 1. Reference numeral 12 designates a tabular cover fixed to an upper opening of the casing 1, covering nearly entire top faces of the fan blades 3. The cover 12, together with the casing 1, makes up the outer housing member of the fan motor 2, having an intake hole 13 of an arbitrary diameter formed for taking in the air from the top side of the casing 1 to the interior thereof. A side of the casing 1 is formed with an exhaust hole 14 surrounded by the casing 1 and the cover 12. A lower face of the casing 1 is formed with another intake hole 15 for taking in the air therefrom, having an arbitrary diameter. Thus, the top and lower faces of the casing 1 which are opposite to the fan 5 and the drive unit 11 provided thereinside are formed with intake holes 13, 15, respectively.

FIG. 3 illustrates a section of one applicable example of the fan motor 2 of FIGS. 1 and 2 which was practically mounted. In the example, an entire body of the fan motor 2 is rectangular-shaped, extending sideways toward the exhaust hole 14, while on an exhaust passage 16 extending from the fan 5 to the exhaust hole 14 in the exhaust direction is provided a heat sink 17 comprising a plurality of radiator fins 17A. The heat sink 17, an equivalent of a radiator, is integrally formed with the casing 1, which, however, may be formed by a separate member indicating good heat conductance, in the case that such integral formation is difficult. A lower face of the casing 1 is formed with a convex heat transferring portion 18. The remaining elements of the fan motor 2 in this example are the same as those shown in FIGS. 1 and 2.

The fan motor 2 of the present embodiment is mounted inside a casing 24 of a notebook type personal computer which incorporates a print board 23 having a top face or components mounting face for mounting thereon heat generation sources such as electronic components 22 and MPU 21. More specifically, the print board 23 is disposed adjacent to a bottom surface 24A of the casing 24, while the aforesaid flat fan motor 2 is accommodated between the components mounting face of the print board 23 and an top face 24B of the casing 24 adjacent a keyboard (not shown). Between a top of the MPU 21 and the heat transferring portion 18 is provided a heat transfer member 25 such as a thermal sheet or grease in close contact therewith, said heat transfer member 25 thermally connecting the MPU 21 to the heat sink 17. A side face 24C of the casing 24 is formed with an opening (not shown) for discharging the air exhausted from the fan motor 2, said opening facing the exhaust hole 14 thereof.

Next will be explained how the above-structured fan motor 2 operates. In FIGS. 1 to 3, arrows without reference numerals indicate the flow of air, respectively.

If a main switch of a notebook type personal computer (not shown) is turned on, the MPU 21 and the electronic components 22 are energized, so that the fan 5, a part of the fan motor 2, is driven by the drive unit 11, thereby starting to rotate the same around the bearing tube 6 inside the casing 1. Then, the heat from the MPU 21 is transferred via the heat transfer member 25 to the heat sink 17, while the heat from the electronic components 22 is emitted mainly into a lower space 26 of the outer housing member 7, so that the air temperature in the lower space 26 of the outer housing member 7 becomes higher than in a top space 27 thereof.

When the fan 5 is rotated, the air of relatively low temperature in the top space 27 of the outer housing member 7 is taken in from the first intake hole 13 into the inside of the fan motor 2. At the same time, the air of relatively high temperature in the lower space 26 thereof is taken in from the second intake hole 15 into the inside of the fan motor 2. As the intake holes 13 and 15 are opposed to each other, with the fan 5 and the drive unit 11 being intervened therebetween, the air taken in from the intake hole 13 does not strike on the lower wall of the casing 1, while the air taken in from the intake hole 15 does not strike on a wall of the upper cover 12, either, and thus, it is smoothly discharged through the exhaust passage 16 to the exhaust hole 14, said exhaust passage 16 defining an opening extending at the right angles to the direction defined by the intake holes 13 and 15. Further, while the air inside the casing 1 is passing through the exhaust passage 16, it strikes the radiator fins 17A of the heat sink 17, thereby efficiently depriving the air of the heat transferred from the MPU 21 to the radiator fins 17A. This way, the air which has reached the exhaust hole 14 is discharged through the opening formed on the side face 24C of the casing 24 to the outside thereof.

The configurations of the intake holes 13 and 15, i.e., the diameters thereof may be arbitrarily varied, depending upon at which ratio to inhale the relatively cold air in the top space 27 of the outer housing member 7 and the relatively hot air in the lower space 26 thereof into the inside of the fan motor 2, respectively. In other words, the diameters of the intake holes 13 and 15 may suitably differ from each other, according to the surrounding structure of the fan motor 2. If the diameter of the intake hole 13 is larger than that of the intake hole 15, the relatively cold air in the top space 27 of the outer housing member 7 is taken in more, which causes the temperature of the air exhausted from the fan 5 to fall, thus generating a favorable effect for cooling the MPU 21. Conversely, if the diameter of the intake hole 15 is larger than that of the intake hole 13, then the relatively hot air emitted from the electronic components 22 in the lower space 26 of the outer housing member 7 is taken in more, thus generating a favorable effect for cooling the electronic components 22.

As discussed in the foregoing, the fan motor 2 of the present embodiment comprises the fan 5 for inhaling and exhausting the air, the drive unit 11 for driving the fan 5, the outer housing member 7 for housing the fan 5 and the drive unit 11, said outer housing member 11 consisting of the casing 1 and the cover 12, wherein the intake holes 13 and 15 are provided in the respective faces of the outer housing member 7, said faces being opposite to the drive unit 11, having an arbitrary diameter, respectively.

As the intake hole 13 or 15 is formed not only the first side face or top face of the outer housing member 7, opposed to the drive unit 11, but also on the second face or lower face thereof, with an arbitrary diameter, respectively, a substantial amount of the air can be taken in from both faces of the outer housing member 7, thereby drastically improving the ventilation efficiency, as compared to conventional ones. Further, even though a substantial inhaling passage cannot be ensured on the top face of the outer housing member 7 when mounting the fan motor 2 to the inside of the casing 24 of an electronic appliance, the second intake hole 15 provided on the lower face of the outer housing member 7 enables the inhaling of the air even through a slight clearance, thereby enhancing the cooling performance. Furthermore, even if the inhaling direction of the fan 5 is orthogonal to the exhaust direction thereof inside the outer housing member 7, the air taken in from either the first intake hole 13 or the second intake hole 15 of the outer housing member 7 does not strike the walls of the casing 1 and the cover 12, but is discharged smoothly toward the exhaust direction of the fan 5, together with the air taken in from either the second intake hole 15 or the first intake hole 13 thereof. Accordingly, unlike conventional fan motors, the fan motor of the invention does not allow the air taken in from the intake holes to strike the walls of the casing and damage the same, whereby the inferior noise performance can be improved.

Besides the foregoing elements, the fan motor of the present embodiment further comprises the heat sink 17 serving as a radiator, provided in the exhaust direction of the fan 5. For example, when the heat from heat sources such as the MPU 21 reaches the heat sink 17 thermally conductibly connected thereto, the air taken in efficiently from the both faces of the outer housing member 7 deprives the heat sink 17 of the heat very quickly in the exhaust direction of the fan 5, thereby effectively suppressing the temperature rise of the MPU 21. As such, the heat sink 17 provided in the exhaust direction of the fan 5 enables the enhancing of the cooling effect relative to the MPU 21 and the like thermally conductibly connected thereto.

Further, in the fan motor of the present embodiment, the intake hole 13 formed on the first face of said outer housing member 7 is opposed to the top face 24B of the casing 24 with the first or top space 27 intervening therebetween, while the other intake hole 15 formed in the second face thereof is opposed to the heat source or electronic components 22 with the second or lower space 26 intervening therebetween. Thus, the relatively cold air in the vicinity of the first face of the outer housing member 7 and the relatively hot air in the vicinity of the second face thereof are taken in simultaneously, and thus are smoothly discharged toward the exhaust direction of the fan 5 while getting mixed together.

Besides the foregoing elements, the fan motor of the present embodiment is further characterized in that the intake holes 13 and 15 have different diameters, respectively. For example, in the event that the heat sources or electronic components 22 are located in the vicinity of the lower face of the outer housing member 7, the intake hole 15 in the lower face of the outer housing member 7 may have a larger diameter than the intake hole 13 in the top face thereof. Thus, the relatively hot air in the vicinity of the lower face of the outer housing member 7 is taken in more than the air in the vicinity of the top face thereof, thereby enhancing the cooling effect relative to the electronic components 22. Conversely, if the intake hole 13 in the top face of the outer housing member 7 has a larger diameter than the intake hole 15 in the lower face thereof, then the relatively cold air in the vicinity of the top face of the outer housing member 7 is taken in more, so that the MPU 21 can be more effectively cooled in the case that the heat sink 17 is provided in the exhaust direction of the fan 5, with the same being thermally conductibly connected to the MPU 21. Accordingly, by adjusting the diameters of the intake holes 13 and 15 to vary depending on the surrounding structure of the fan motor 2, the cooling effect can be enhanced under the most desirable condition.

Also besides the foregoing elements, the fan motor of the present embodiment is further characterized in that the casing 1 which constructs the outer housing member 7 is made from a material with good heat conductance. Thus, if the casing 1 is thermally conductibly connected to the MPU 21 and the like, the heat from the MPU 21 can be speedily transferred to the casing 1, thereby effectively emitting the heat to the outside, by the air taken in from the intake holes 13 and 15.

Figure 4:
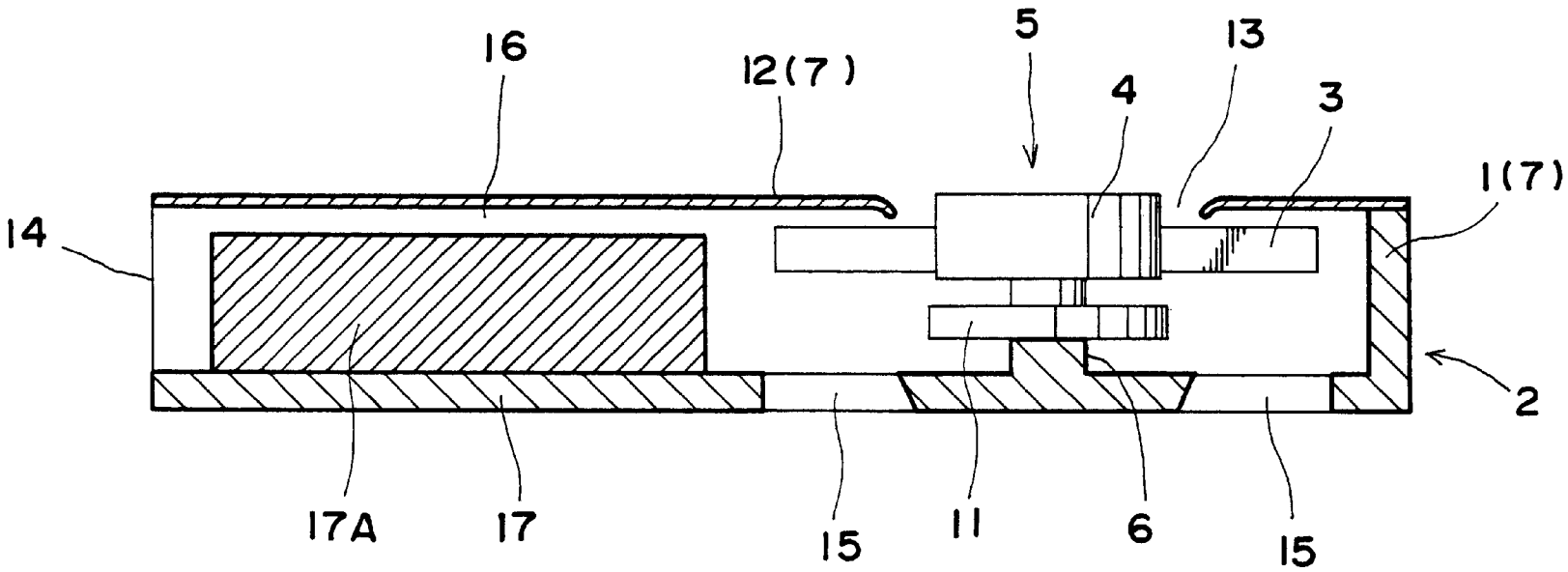
FIG. 4 is a section of a fan motor in accordance with a second embodiment.
Figure 5:
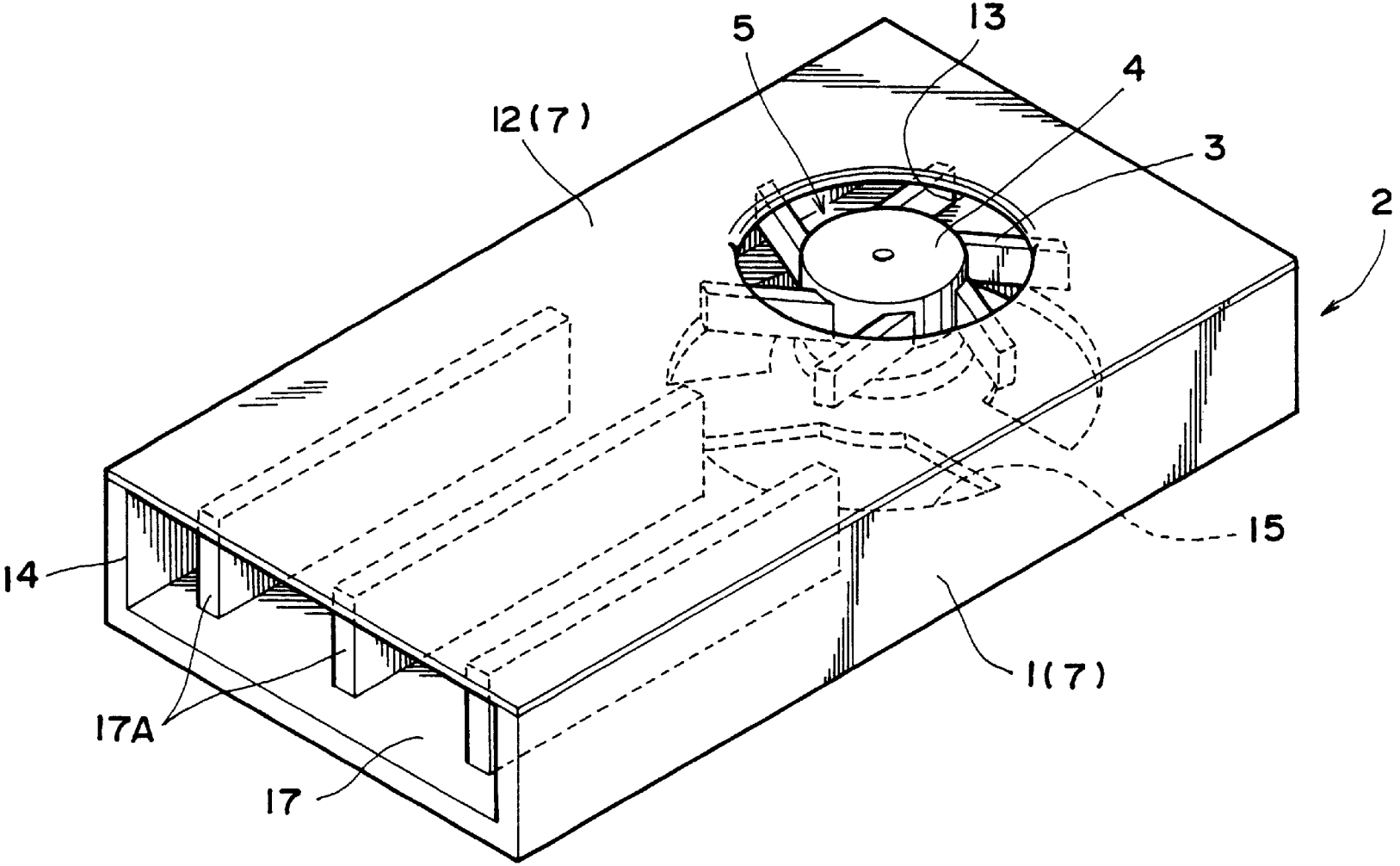
FIG. 5 is a perspective view of a fan motor of FIG. 4.

Next, a second embodiment of the invention is explained with reference to FIGS. 4 and 5, wherein the same portions as those described in the first embodiment are designated by the same reference numerals, and their repeated detailed descriptions are omitted.

In the second embodiment, a plurality of the radiator fins 17A of the radiator heat sink 17 are vertically provided so as to align to the flow of air. Thus, the flow of the air exhausted from the fan 5 is allowed to flow more smoothly without being so much disturbed by the radiator fins 17A, thus effectively depriving the fins 17A of the heat transferred thereto from the MPU 21. Incidentally, other structures and advantages of the second embodiment are the same as those discussed in the first embodiment.

The present invention should not be limited to the foregoing embodiments, but may be variously modified within a scope of the invention. For example, as the fan motor 2 of the embodiments is a flat type, it may be mounted for the purpose of radiating and cooling the inside of a variety of other thin electronic appliances than notebook personal computers. Further, the exhaust hole 14 may be provided not only at one side of the fan motor 2, but also on plural sides thereof.

What is claimed:

1. A fan motor to be mounted to an inside of a casing of a thin electronic appliance such as a personal computer, comprising:

a fan for inhaling and exhausting air in a manner that an inhaling direction of air is perpendicular to an exhausting direction thereof;

a drive unit for driving said fan;

an outer housing member for accommodating said fan and drive unit, at least a part of said outer housing member being made from a material with good heat conductance, formed with a heat transferring portion thermally conductively connected to a heat source of the thin electronic appliance, said outer housing member having a first face and a second face which are opposite to said drive unit; and an intake hole provided in each face of said outer housing member, defining a first intake hole in the first face and a second intake hole in the second face, each said intake hole having a diameter for inhaling air in the vicinity of said first face and said second face;

wherein said fan includes a rotor and a plurality of fan blades formed on an outer peripheral side surface of the rotor, said rotor having a diameter defined by the outer peripheral side surface thereof; and wherein said first and second intake holes supply air to said fan from respective opposite sides thereof, and have different diameters which are larger than that of said rotor.

2. The fan motor according to claim 1, wherein a radiator is provided in an exhaust direction of said fan.

3. The fan motor according to claim 1, wherein the intake hole formed on the first face of said outer housing member is opposed to a face of a thin casing of an electric appliance with a first space intervening therebetween, while the other intake hole formed in the second face thereof is opposed to heat source with a second space intervening therebetween.

4. The fan motor according to claim 1, wherein said first intake hole has a larger diameter than said second intake hole.

5. The fan motor according to claim 1, wherein said second intake hole has a larger diameter than said first intake hole.

* * * * *